United States Patent [19]

Becker et al.

[11] 4,145,042

[45] Mar. 20, 1979

[54] SLIDE

[75] Inventors: Klaus Becker, Wetter; Uwe Lichtenvort, Essen; Dieter Behrmann, Hagen, all of Fed. Rep. of Germany

[73] Assignee: DEMAG Aktiengesellschaft, Duisburg, Fed. Rep. of Germany

[21] Appl. No.: 774,033

[22] Filed: Mar. 3, 1977

[51] Int. Cl.[2] ..... A63G 21/10; A63G 21/18

[52] U.S. Cl. ..... 272/56.5 R

[58] Field of Search ..... 272/56.5 R, 56.5 SS, 272/32, 1 R, 1 B, 7, 2; 104/53, 56, 57, 59, 63, 67, 68, 69, 70, 72, 73, 86, 134, 136, 275, 276, 277; 52/187, 176; 182/48, 49; 193/12, 13, 35 S, 42; 61/14, 15

[56] References Cited

U.S. PATENT DOCUMENTS

| | | | |
|---|---|---|---|
| 277,156 | 5/1883 | Pardessus | 182/48 X |
| 419,860 | 1/1890 | Libbey | 104/73 |
| 468,792 | 2/1892 | Critchlow | 104/56 |
| 489,963 | 1/1893 | Lehmann | 104/56 |
| 506,238 | 10/1893 | Kirker | 272/56.5 R UX |
| 1,192,445 | 7/1916 | Medart | 272/56.5 R |
| 1,200,686 | 10/1916 | Youngblood | 182/48 |
| 3,083,015 | 3/1963 | Barenholtz et al. | 272/56.5 R |
| 3,363,583 | 1/1968 | Greenberg | 272/56.5 SS X |
| 3,556,522 | 11/1968 | Gale | 272/56.5 R |
| 3,902,948 | 9/1975 | Morros | 52/187 X |

FOREIGN PATENT DOCUMENTS

| | | | |
|---|---|---|---|
| 595244 | 7/1925 | France | 52/176 |
| 22685 of | 1895 | United Kingdom | 104/56 |
| 1382777 | 2/1975 | United Kingdom | 52/187 |

OTHER PUBLICATIONS

American Spiral Slides, American Playground Device Co., Anderson, Indiana.

*Primary Examiner*—Richard J. Johnson
*Assistant Examiner*—Arnold W. Kramer
*Attorney, Agent, or Firm*—Mandeville and Schweitzer

[57] ABSTRACT

A slide is provided, preferably a water slide, which is self-supporting and may be erected adjacent any amusement location. The slide of the invention provides a substantially longer sliding surface for the amusement of users without requiring an inclined ground surface for support of the slideway. The slide incorporates a pathway for ascending the slide, and preferably a water supply facility to enhance the sliding action. The entire structure is supported on one or more vertical supports resting on the ground.

14 Claims, 6 Drawing Figures

SLIDE

BACKGROUND AND STATEMENT OF THE INVENTION

The invention involves a slide, preferably a water slide for use by people, and consisting of a trough-shaped slide supported by at least one vertical support. The slide surface may be kept moist by water where people slide without using any means in the nature of a sled or mat. However, it is within the purview of the invention to utilize the slide of the invention incorporating a low friction material on the slide surface.

Water slides with comparatively short straight sliding surfaces have been known for some time, including toboggin type slides. Representative of such arrangements is the slide disclosed in U.S. Pat. No. 1,551,249. Other water slides of greater length have been proposed using an inclined ground surface to support the slide. Representative of such slides is that disclosed in U.S. Pat. No. 3,923,301. However, such arrangements are limited because they require that the slide be built at a location providing the proper support, they are relatively expensive, and they require substantial ground area.

With this invention, by contrast, a slide may be manufactured of any length to be utilized anywhere. This is done by providing a coiled slide or helix spiraling around a vertical support to provide a slide tower. Such tower-like slides can reach a height, for example, of approximately 10 meters, and a length of approximately 100 meters with three winding turns, and a diameter of roughly 11 meters. Such dimensions exceed existing self-supporting slides in length by ten times, and require no special land terrain. These dimensions are purely illustrative and slides of greater and smaller dimensions may be produced, according to the invention, as will be understood by practioners in the art. The slide may be assembled at any poolside or any other desired location. This type of slide, which is considerably longer than the usual kind, can greatly enhance the attraction of an amusement facility, as will be understood.

Also, as will be appreciated, several tower-like multiple-turn slides constructed according to the invention may be connected in succession. A straight run may be inserted between the tower-like slides. When using several slide towers the coils may be positioned in opposite directions, which results in a more diversified sliding effect.

If the slide of the invention is in the form of a water slide, the top of the slide is provided with a water tank, and the bottom is positioned adjacent a water basin. A water pipe leads to the upper tank supplying enough water to keep the slide wet with water. A greater quantity of overflowing water results in higher sliding speeds than if less water is used, as the water tends to flush people down the slide. A great water quantity also causes people to be swept away from the lower end of the slide. This action can be increased by arranging a water jet in the water body adjacent the lower end of the slide to force people away from the slide's lower end. This may be achieved by using a strong circulating pump, which agitates the water in the manner of a so-called counterflow installation. In this fashion, the water basin at the lower end of the slide is kept free, and accidents are thus avoided.

Preferably, in accordance with this invention the slide is formed by several segments whose upper ends have an offset underlap to accommodate the lower end the next succeeding segment. The segments facilitate a slide construction of any desired length. The construction of the invention allows for the use of uniform segment length, and although not required, this uniformity reduces cost, as will be appreciated.

The slide segments may be constructed of any appropriate material providing the strength requirements for such construction. Asbestos concrete has proved useful in such construction. Certain thermoplastics may also be used if properly filled to provide the required rigidity. Also, low friction surfaces comprised of material such as polytetrafluoroethylene may be used with or without the incorporation of water.

The slide of the invention includes a path without any steps positioned, preferably, at the inside of the bend of the slide, and covered with a non-skid coating. Preferably steps are avoided as much as possible as users might hurt their toes. A divider area may be provided between the slide and the path to segregate these areas and avoid collisions between people ascending the path and people sliding down.

Preferably, the slide sliding surface is semi-circular in cross section with an integral elevated safety rim at the outer edge. The safety rim is, according to the invention, in the form of an inverted U, which receives the support brackets from below. The shape of the slide segments and their integral curved rims impart so much rigidity, that the segments are supported on the curved rims only at the ends. However, the slide may be fitted with a railing at the outer bend, instead of the safety rim in order to change the appearance. The access path is enclosed on both sides with a railing. The railing is comprised of a plurality of generally U-shaped segments with a horizontal top piece joining two vertical spaced pieces supported on the structural support of the slide. The individual railing parts are so short that it is not necessary to bend the upper portion, i.e. the hand grip. Another railing is provided around the edge of the top platform.

In accordance with one embodiment of the invention, the vertical support is provided in the slide center, which carries cantilevered brackets for the slide, the divider area and the access path, as well as the railing. Instead of one central support, several supports may be arranged along the slide, specifically in the divider area so as to avoid interference with the slide itself, or the access path. In this embodiment, the supports are interconnected by means of longitudinal pieces inclined to match the slide incline. Such longitudinal pieces preferably consist of pipes, with the ends fitted with flanges positioned in flange plates on both sides of the supports.

For higher slide towers the supports may be arranged on both sides of the path, and connected by flange plates. The longitudinal pieces mentioned above carry cantilevered brackets supporting the path, the divider area, and the slide proper, as well as the railing. Height-adjustable means extend between the supporting brackets and the slide, the divider area, and the access path to facilitate exact height settings.

The flange plates are provided with boreholes matching the diameter of the tubular longitudinal pieces. These boreholes and the longitudinal pieces house a water supply line leading to the upper water tank, or the entrance to the slide. The diameter of such water supply line is dimensioned to allow a sufficient water supply to be pumped up to moisten the slide. Provisions for adding water at points along the slide may be provided, if desired. They may be positioned in the safety rim, and simply let the water run down. Or they may be positioned at the inner curved rim and shoot the water against the outer curved safety rim. In the latter arrangement, people using the slide must pass through the water jet.

As purely illustrative of a slide embodying the invention, one may note the following detailed description of an example of a water slide tower positioned adjacent a swimming pool, with a plurality of vertical supports supporting the slide and its adjacent service areas in cantilevered fashion.

DETAILED DESCRIPTION OF A PREFERRED EMBODIMENT OF THE INVENTION

Figure 1:
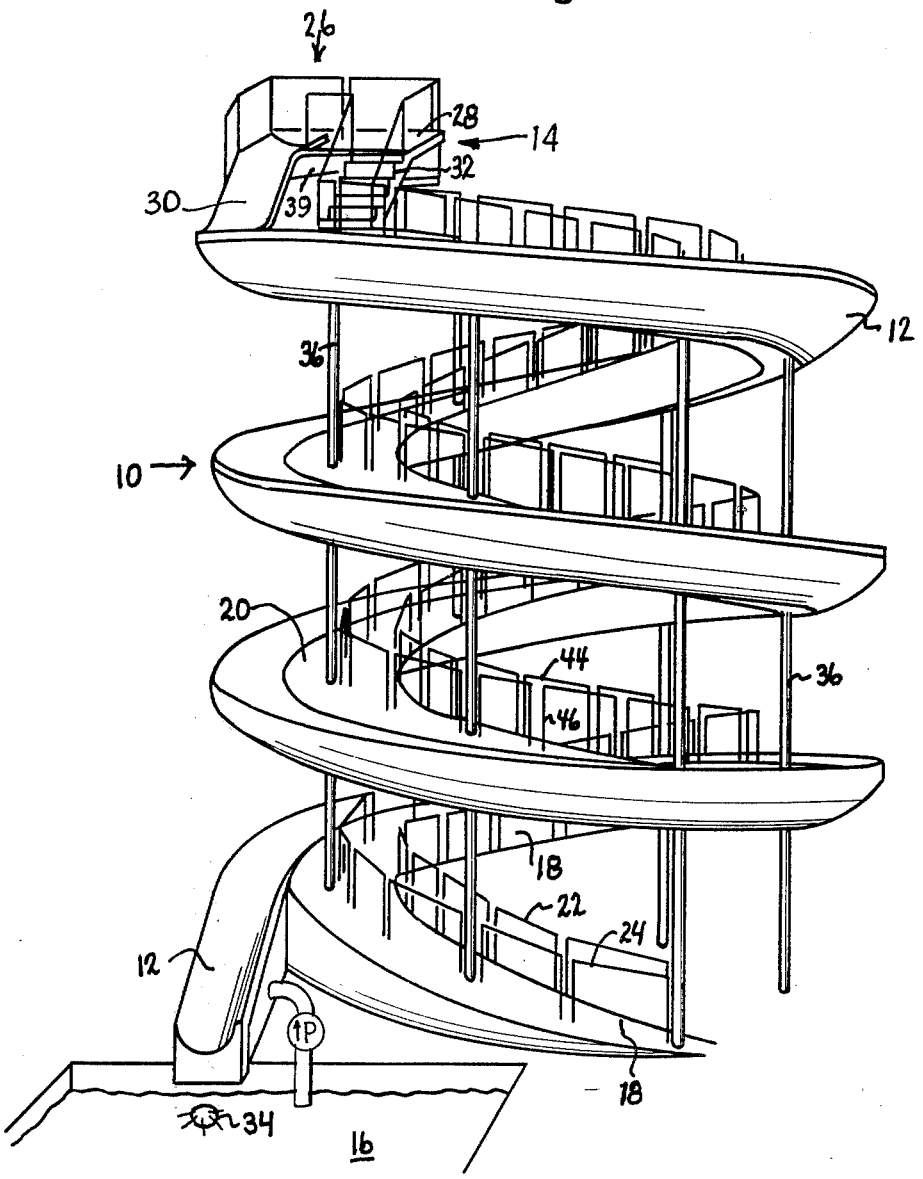
FIG. 1 is a perspective view of a water slide tower embodying the invention.

Referring to the drawings in which like reference characters refer to like parts throughout the several views thereof, FIG. 1 shows a water slide tower generally designated 10 having an inclined slide path 12 extending from an upper platform generally designated 14, to a pool 16 below. The slide 12 includes an upper segment 30 of greater incline to enhance the initial slide action. Integral with slide 12 is an access path 18 joined at the inner edge of slide 12 by a divider or transitional area 20. This divider area provides a segregation between the access path 18 and people walking up that path, and the slide path 12 so that there are no collisions between people ascending the path and people sliding down slide 12. Positioned on either side of access path 18 are railings 22, 24 which assist in ascending path 18. Also, a railing designated generally 26 surrounds upper platform 28 which is built on top of an upper water tank supply 39. Path 18 ends at the top in a stairway 32 positioned adjacent slide portion 30 to gain access to the top of the tower 10. The railings 22, 24 and 26 are preferably comprised of a plurality of U-shaped segments with a horizontal top piece 44 joining the spaced vertical pieces 46 supported on path 18.

Preferably, the incline of slide 12 will be about 10% from horizontal, while the incline of access path 18 will be about 20%. Preferably, also, access path 18 will be provided with a non-skid coating. As can be seen in FIG. 1, the arrangement of railings 24 is such that people ascending path 18 may cross over the slide 12 prior to reaching the top, if desired. Also, they may pass in the opposite direction if so desired.

As can be seen in FIG. 1, a water jet opening 34 is provided in order to enhance the water flow immediately adjacent the exit end of slide 12 to facilitate moving people away from the end of slide 12 out of the way of other people following. A pump or other device may be utilized to facilitate providing the water jet from opening 34, as will be appreciated. As can be seen in FIG. 1, water slide tower 10 is supported on a plurality of vertical stanchions 36 supported, in turn, on a ground area adjacent pool 16. With such an arrangement, the tower water slide of FIG. 1 may be positioned at any location without the need for an inclined ground surface for support.

Figure 2:
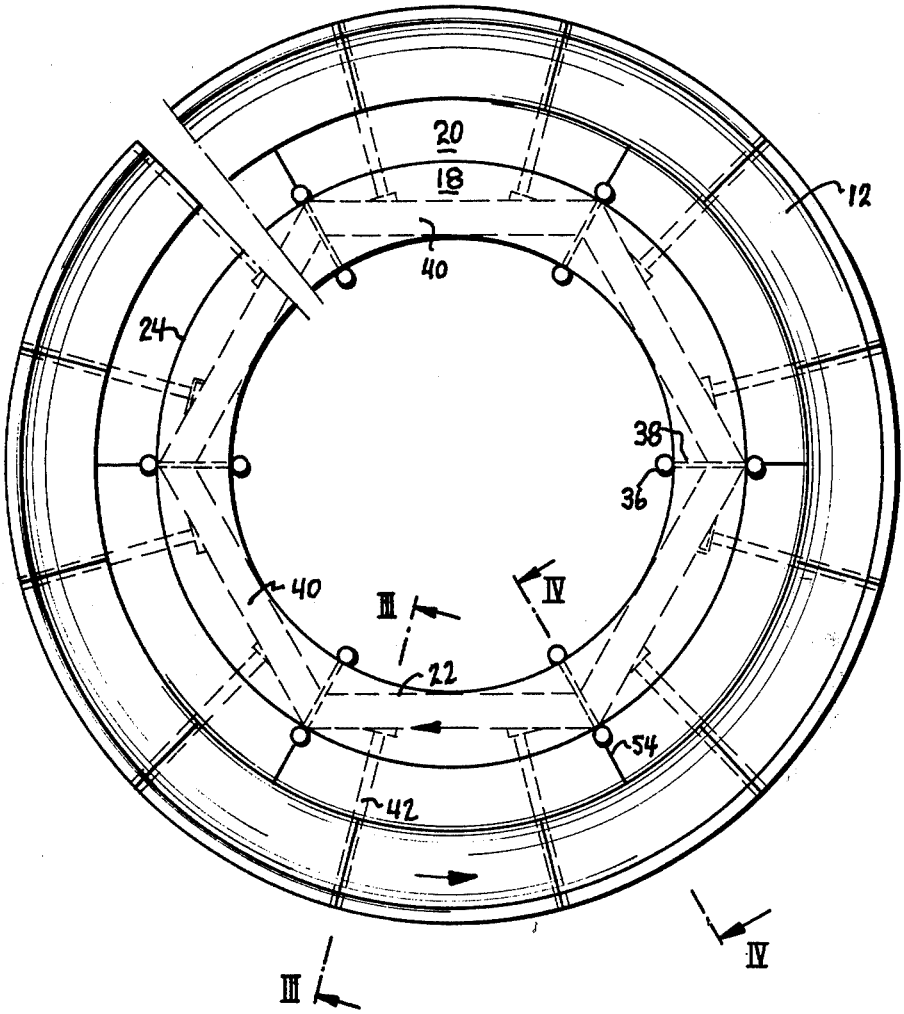
FIG. 2 is a plan view of a water slide support embodying further aspects of the invention.

Referring now to FIG. 2, a further embodiment of slide is shown of the invention in which a plurality of adjacent vertical stanchions 36 are shown in pairs arranged in a circle to conform to the helix of the slide. Each pair of stanchions 36 is connected by flange plate 38. The flange plates 38 are, in turn, connected or interconnected by longitudinal braces 40, which, in turn, support in cantilever fashion elongated slide support brackets 42 and short slide support brackets 54. The individual segments forming slide 12 extend from one elongated cantilevered bracket 42 to the next, with the segments resting on height adjustable supports 60, 56, as shown in FIG. 3.

Figure 3:
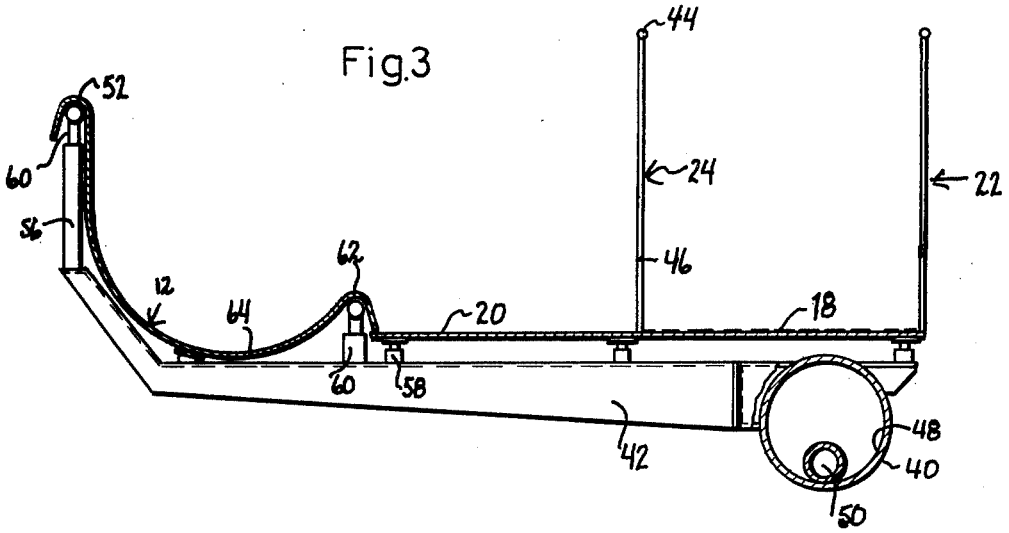
FIG. 3 is a cross sectional view taken along lines III—III of FIG. 2.

As can be seen in FIG. 3, longitudinal braces 40 are circular in cross section to form a bore 48 for accommodating a water line 50. Cantilevered and supported on brace 40 is the substantially L-shaped cantilevered bracket 42 which carries on the upper surface thereof access path 18, divider area 20 and slide 12. As can be seen in FIG. 3, the segments forming slide 12 include a generally semi-circular slide surface portion 64 ending on the outside of the helix in a raised U-shaped safety railing 52, and on the inside with a generally U-shaped rim 62. Rim 62, in turn is joined to the divider portion 20.

Disposed on the end of each cantilevered bracket 42 is a vertical support 56, carrying height adjustable support 60 extending under U-shaped outer rim 52. Also supported on the top of path 18 are the spaced railings 22, 24. Access path 18 and divider or transitional area 20 are also supported in turn on brackets 42 by height spacer elements 58. As will be appreciated, the raised outer portion 52 of slide 12 prevents people using the slide from falling off of the slide at the outer edge thereof.

Figure 4:
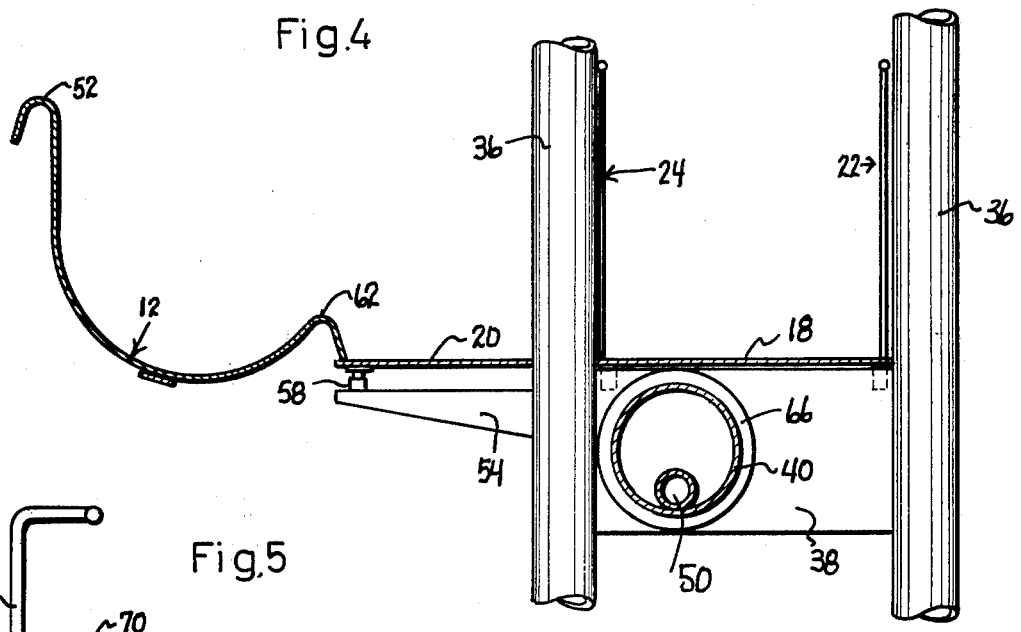
FIG. 4 is a cross sectional view taken along lines IV—IV of FIG. 2.

As can be seen in FIG. 4, braces 40 are supported at each end in circular flanges 66 positioned on flange plates 38. In this area, a short cantilevered support bracket 54 extends to support transition or divider area 20, but no support is provided for the slide 12 itself. Because of the particular cross section of slide 12 with its curved rim areas, the individual segments forming the slide provide sufficient rigidity so that no support is needed in this area.

Figure 5:
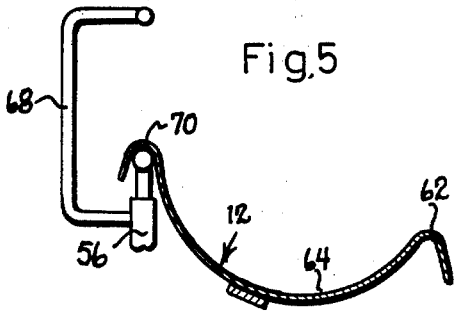
FIG. 5 is a sectional view of another slide support arrangement embodying the invention.
Figure 6:
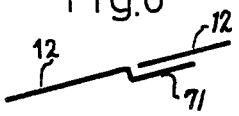
FIG. 6 is a partial longitudinal section showing the connection between adjacent segments forming the slide of the invention.

In the embodiment shown in FIG. 5, a different form of slide segment 12 is shown with a much lower outer rim 70. In lieu of a raised outer safety rim 52, as shown in FIGS. 3 and 4, the embodiment shown in FIG. 5 includes a generally U-shaped safety rail 68 connected to vertical support 56. Each of the individual succeeding segments of slide 12 include an integral lip 71 at the upper edge thereof which lip 71, accommodates the lower edge of the next succeeding upper segment, as shown in FIG. 6. Thus, each succeeding lower segment forming the slide 12 serves to support and prevent sliding of the next succeeding segment above.

Thus, as will be apparent from the foregoing, there are provided in accordance with this invention self-sustaining slide towers which may be assembled at any location without regard to a special form of terrain for use to support the slide. Furthermore, the slide structures of the invention include provisions for incorporating water slide aspects to the slide tower, and the arrangement is such that a plurality of such towers may be joined together to enhance the attractiveness of the device for amusement purposes. In addition, as will be apparent from the foregoing discussion, the slide tower structure of the invention is comparatively inexpensive to construct in relation to the length of the slide provided and the attractiveness thereof for users.

While the forms of apparatus herein disclosed form preferred embodiments of the invention, it is to be understood that the invention is not limited to those specific forms of apparatus and changes can be made therein without departing from the scope of the invention in which is defined in the appended claims. For example, and as mentioned above, the slide surface may incorporate antifriction properties in lieu of the application of water. Furthermore, while the slide surface is disclosed as being formed of a plurality of segments, it will be appreciated that a single elongated slide structure integral from top to bottom may be formed in helical fashion. In addition, even though the slide segments may be of uniform size to reduce cost, it will be appreciated that segments of varying dimensions may be utilized in order to accommodate a particular configuration of helical slide on the tower structures of the invention.

We claim:

1. A self-supporting tower slide for people which may be assembled on any relatively level surface, comprising
(a) an upper slide access platform;
(b) a ground level slide exit;
(c) a continuous slide extending from said upper slide access platform to said slide exit;
(d) said slide having a semi-circular slide surface; the improvement characterized by
(e) said slide formed as a helix;
(f) a vertical support for said slide including a plurality of pairs of vertical stanchions of varying height arranged in a circle and extending to said slide;
(g) a flange plate connecting each pair of vertical stanchions;
(h) a horizontal brace extending between each said flange plate;
(i) each said horizontal brace being tubular and inclined from horizontal the same amount of incline as the adjacent slide surface;
(j) a bore in each flange plate adjacent the connections of said horizontal braces;
(k) a tubular flange connecting each said horizontal brace to each said flange plate;
(l) an inclined helical access path adjacent said slide;
(m) a divider area formed between said helical slide surface and said helical access path; and
(n) said slide, said divider area and said access path are integral.

2. The apparatus of claim 1, further characterized by
(a) said slide helix includes at least three flights.

3. The apparatus of claim 1, further characterized by
(a) a source of water adjacent the exit end of said slide;
(b) a water tank adjacent said upper slide access platform;
(c) a water line extending between said source and said tank;
(d) pump means for moving water from said source to said tank; and
(e) means for flowing water from said tank down said slide.

4. The apparatus of claim 3, further characterized by
(a) said source of water is a water basin;
(b) a water jet in said basin adjacent the exit end of said slide for moving people away from said exit end; and
(c) pump means for supplying said water jet.

5. The apparatus of claim 1, further characterized by
(a) said slide is comprised of a plurality of segments placed end to end; and
(b) a depending lip extending transverse of the upper edge of each said segment; and
(c) the bottom edge of each segment engaging the depending lip of the next succeeding segment below.

6. The apparatus of claim 1, further characterized by
(a) a railing disposed along the outer edge of said slide.

7. The apparatus of claim 1, further characterized by
(a) a railing disposed along each edge of said access path.

8. The apparatus of claim 1, further characterized by
(a) said slide includes raised inner and outer integral rims;
(b) said inner and outer rims are generally in the form of an inverted U in cross-section; and
(c) said outer rim is raised to form a safety rim.

9. The apparatus of claim 8, further characterized by
(a) a plurality of horizontal cantilevered brackets extending from said vertical support;
(b) each said bracket including an outer vertical component; and
(c) the upper edge of each said outer vertical component received in said outer raised safety rim.

10. The apparatus of claim 9, further characterized by
(a) a railing adjacent the outer edge of said slide; and
(b) said railing supported along the outer edge of said plurality of cantilevered brackets.

11. The apparatus of claim 1, further characterized by
(a) a plurality of horizontal cantilevered brackets connected to said horizontal braces; and
(b) said cantilevered brackets extending outwardly from said vertical stanchions to support said slide, said path and said divider area.

12. The apparatus of claim 11, further characterized by
(a) a plurality of height adjustable connections extending between said brackets, and said path, said slide and said divider area.

13. The apparatus of claim 12, further characterized by
(a) a water basin adjacent the exit end of said slide;
(b) a water tank adjacent the said upper slide access platform;
(c) a water line extending between said basin and said tank;
(d) pump means for moving water from said basin through said water line to said water tank;
(e) means for flowing water from said tank down said slide; and
(f) said water line extending through said tubular inclined horizontal braces and said bores in said flange plates.

14. A self-supporting tower slide for people which may be assembled on any relatively level surface, comprising
(a) an upper slide access platform;

(b) a ground level slide exit;

(c) a continuous slide extending from said upper slide access platform to said slide exit;

(d) said slide having a semi-circular slide surface; the improvement characterized by (e) said slide formed as a helix;

(f) a vertical support for said slide including a plurality of pairs of vertical stanchions of varying height arranged in a circle and extending to said slide;

(g) a flange plate connecting each pair of vertical stanchions;

(h) a horizontal brace extending between each said flange plate;

(i) each said horizontal brace being tubular and inclined from horizontal the same amount of incline as the adjacent slide surface;

(j) a bore in each flange plate adjacent the connections of said horizontal braces;

(k) a tubular flange connecting each said horizontal brace to each said flange plate; and (l) access means extending from the ground to said upper access platform and supported on said plurality of vertical support stanchions.

* * * * *